United States Patent [19]

Morishita et al.

[11] 4,250,785

[45] Feb. 17, 1981

[54] TURRET TYPE PUNCH PRESS HAVING A PLURALITY OF STRIKERS

[75] Inventors: Akio Morishita, Kagamihara; Masayoshi Mizukado, Gifu; Naoe Fukumura, Inuyama, all of Japan

[73] Assignee: Yamazaky Iron Works, Japan

[21] Appl. No.: 73,561

[22] Filed: Sep. 7, 1979

[30] Foreign Application Priority Data

Jun. 2, 1979 [JP] Japan ..... 54-69081

[51] Int. Cl.[3] ..... B26F 1/04

[52] U.S. Cl. ..... 83/552; 83/618

[58] Field of Search ..... 29/36, 39; 72/324, 327, 72/333; 83/549, 550, 551, 552, 618, 534; 234/38, 113

[56] References Cited

U.S. PATENT DOCUMENTS

| | | | |
|---|---|---|---|
| 3,449,991 | 6/1969 | Daniels | 83/552 X |
| 3,685,380 | 8/1972 | Daniels | 83/534 X |
| 3,895,550 | 7/1975 | Daniels | 83/549 X |
| 3,938,416 | 2/1976 | Beauplat | 83/552 |
| 3,972,260 | 8/1976 | Hayashi et al. | 83/549 |
| 4,091,700 | 5/1978 | Cloup | 83/549 X |

*Primary Examiner*—Frank T. Yost
*Assistant Examiner*—Robert P. Olszewski
*Attorney, Agent, or Firm*—Blair, Brown & Kreten

[57] ABSTRACT

A turret type punch press which has a plurality of strikers is disclosed. The punch press comprises a turret mechanism, a plurality of large-diametrical punches radially spaced along a main circular track of the turret mechanism, a plurality of small-diametrical punches spaced along a plurality of subtracks centering around points on the main circular track between every two adjacent large-diametrical punches, a main striker provided in the lower end of a ram to correspond with the large-diametrical punches and a plurality of substrikers provided circumferentially along the main striker to correspond with the small-diametrical punches. The main striker and the substrikers are selectively operated according to selection of the punches.

3 Claims, 10 Drawing Figures

TURRET TYPE PUNCH PRESS HAVING A PLURALITY OF STRIKERS

BACKGROUND OF THE INVENTION

1. Field of the Invention

The present invention relates to a turret type punch press which has a plurality of strikers.

2. Description of the Prior Art

In a conventional turret type punch press, a striker is shifted radially along the turret mechanism to select a punch to be struck by the striker. However, since the striker is shifted linearly and reciprocally, the construction becomes complicated and a noise is generated by changes in acceleration caused by reciprocal movement of the striker. When the punching speed is increased, acceleration is changed rapidly leading to malfunction of the punch press.

SUMMARY OF THE INVENTION

It is the object of the present invention to provide a new and improved turret type punch press which can overcome the aforementioned disadvantages of the prior art.

According to the present invention, there is provided a turret type punch press having a plurality of strikers, which comprises a turret mechanism, a plurality of large-diametrical punches radially spaced along a main circular track of the turret mechanism, a plurality of small-diametrical punches spaced along a plurality of subtracks centering around points on the main circular track between every two adjacent large-diametrical punches, a main striker provided in the lower end of a ram to correspond with the large-diametrical punches and a plurality of substrikers provided circumferentially along the main striker to correspond with the small-diametrical punches, and the main striker and the substrikers are selectively operated according to selection of the punches.

DESCRIPTION OF THE PREFERRED EMBODIMENT

Figure 1:
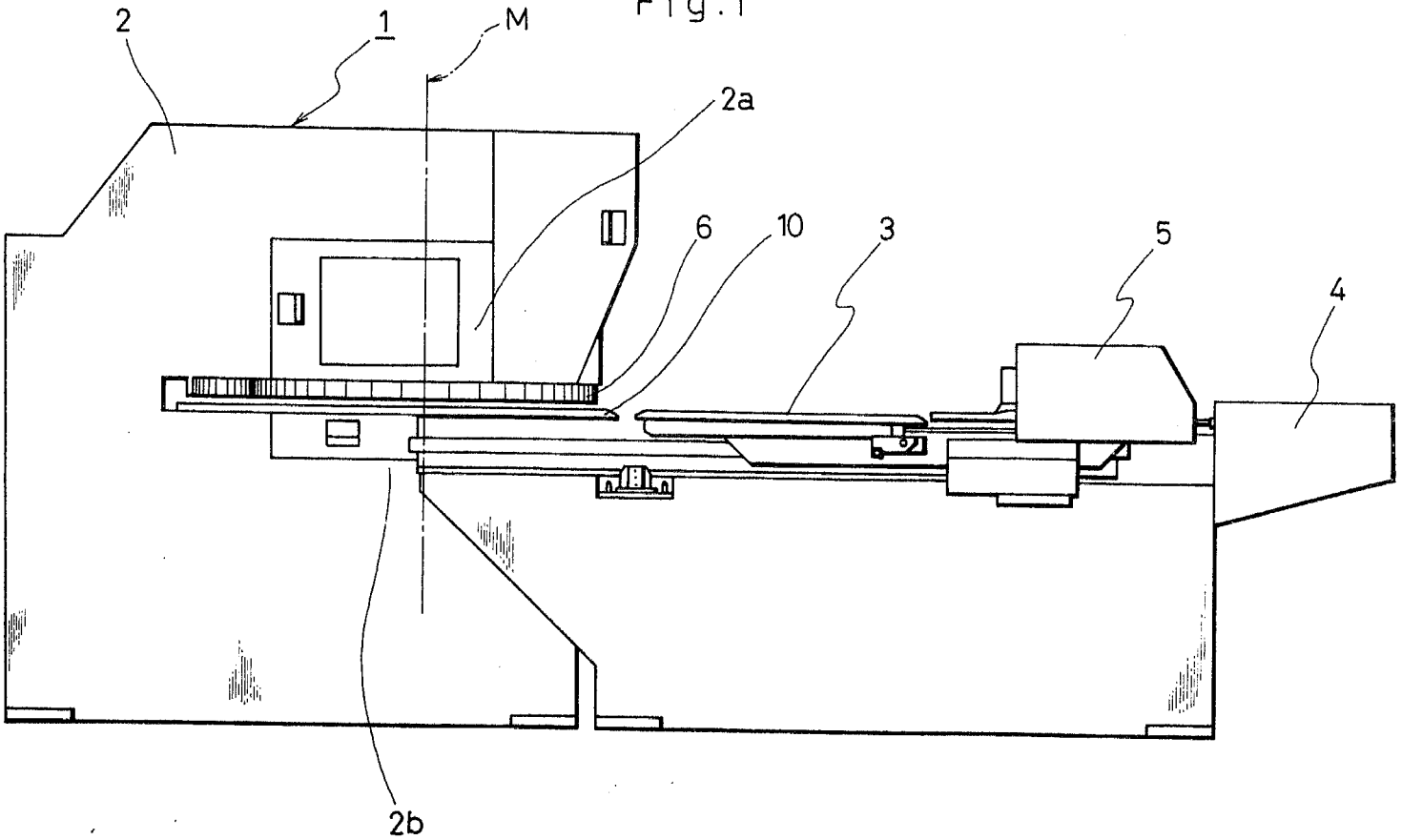
FIG. 1 is a side elevational view of the turret type punch press according to the present invention.
Figure 2:
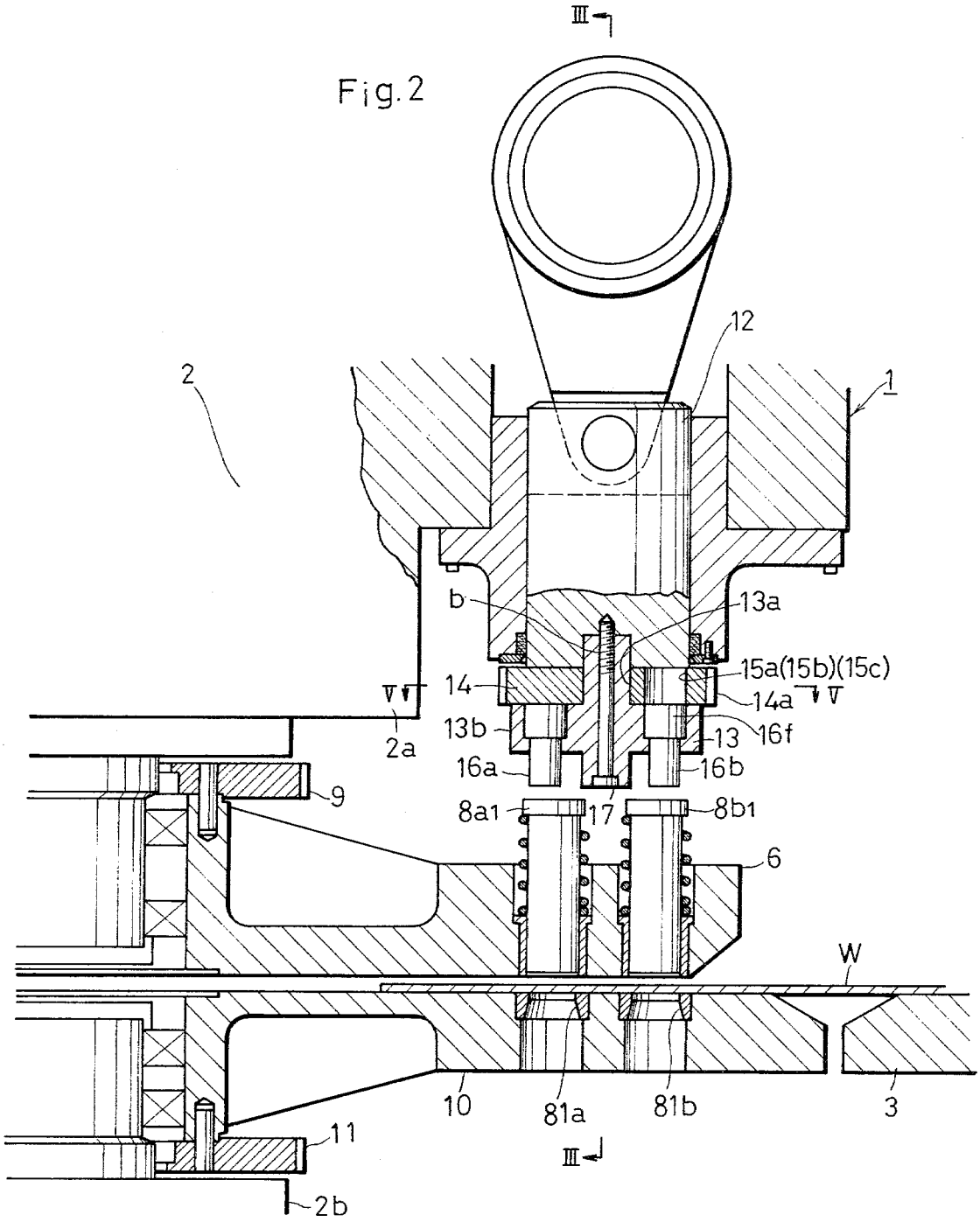
FIG. 2 is an enlarged longitudinal cross-sectional view of the punching portion of the punch press as shown in FIG. 1.
Figure 3:
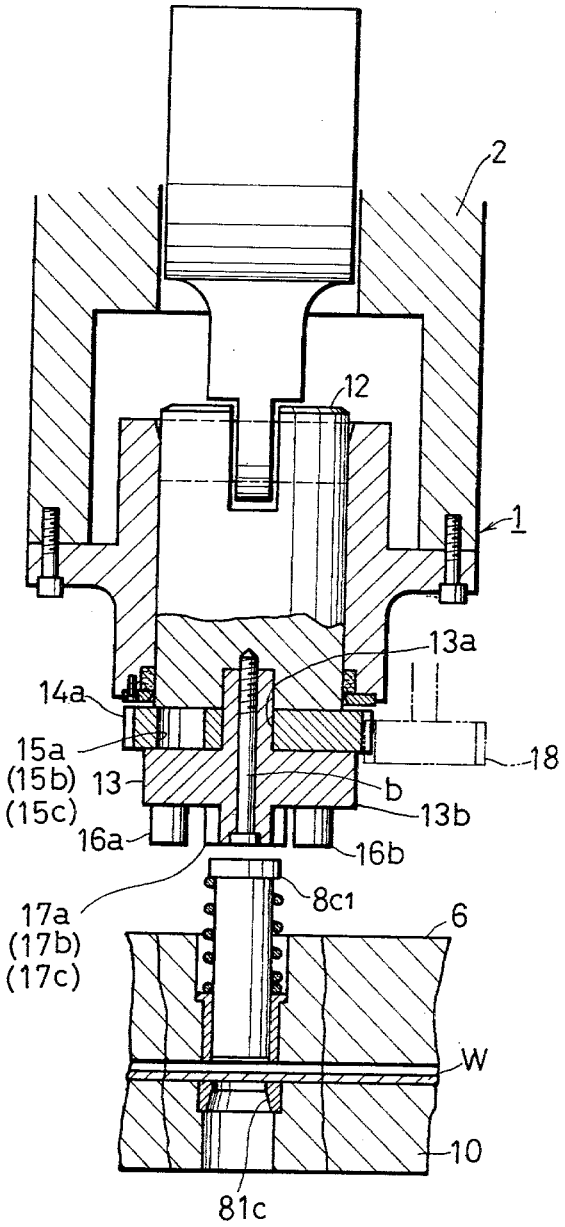
FIG. 3 is a cross-sectional view taken along the lines III—III in FIG. 2.
Figure 4:
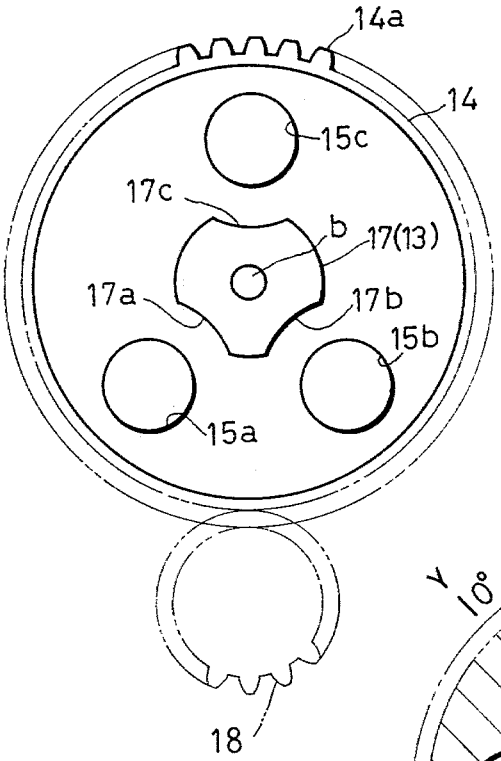
FIG. 4 is a bottom plan view of a ram having the strikers.
Figure 7:
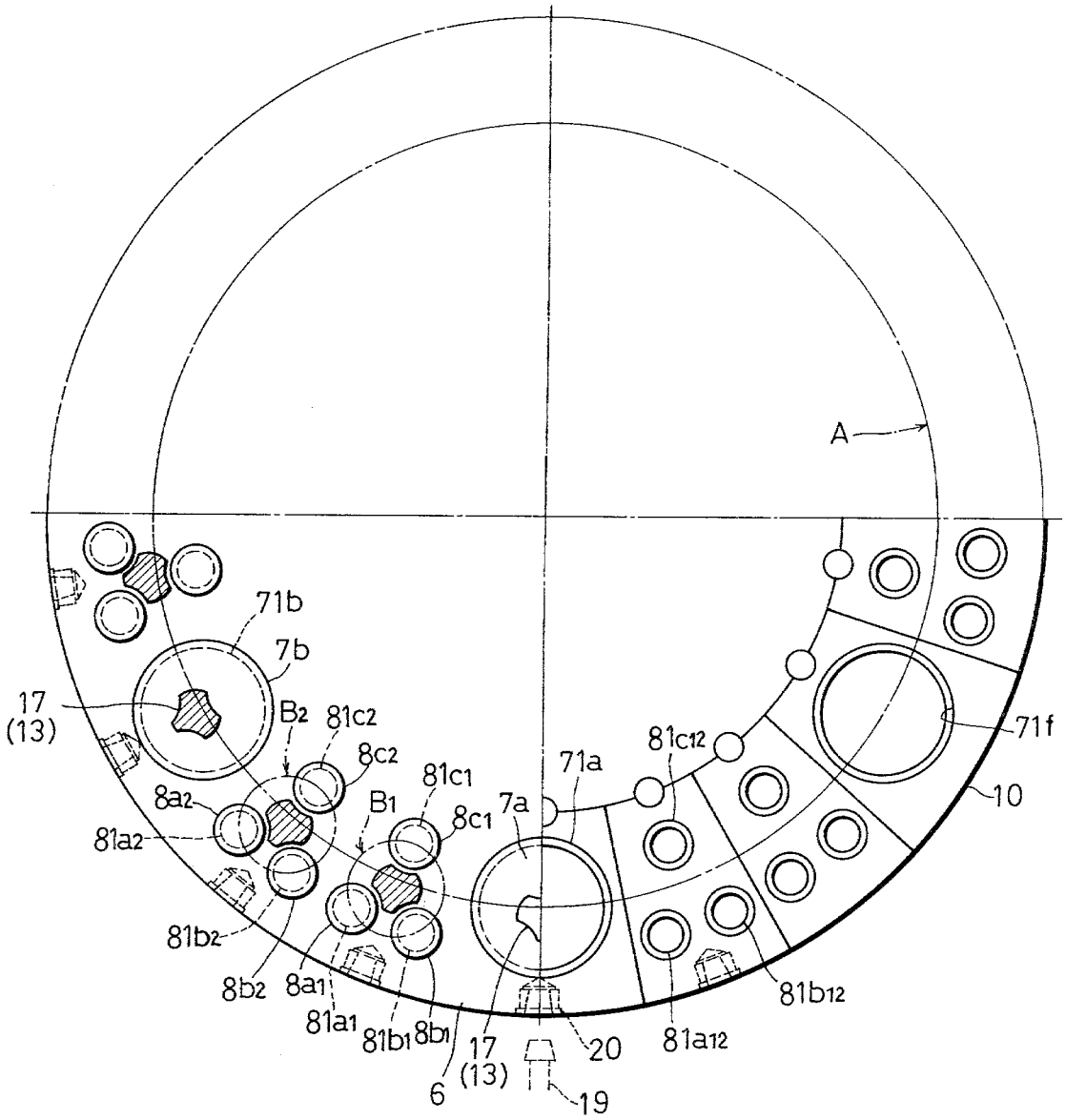
FIG. 7 is an enlarged partially fragmentary plan view of the turret mechanism provided with the punches.

Referring now to FIGS. 1 through 3 of the drawings, numeral 1 indicates a C-frame punch press and numeral 2 indicates the body thereof. In front of the press body 2, there are provided a supporting table 3 for a plate-shaped work-piece W, a positioning means 4 for power feed of the work-piece W in the longitudinal direction and another positioning means 5 for power feed of the work-piece W in the transverse direction. An upper frame 2*a* of the press body 2 carries a circular upper turret 6 which is horizontally rotatable along its central axis M. As shown in FIG. 7, the upper turret 6 is provided with a plurality of large-diametrical punches 7*a*, 7*b*, . . . radially spaced along a main circular track A and a plurality of small-diametrical punches 8*a*1, 8*b*1, 8*c*1, . . . spaced along circular subtracks B1, B2, . . . centering around points on the main circular track A between every two adjacent large-diametrical punches 7*a*, 7*b*, . . . Although centers of each three small-diametrical punches 8*a*1, 8*a*2, . . . along each of the circular subtracks B1, B2, . . . form an equilateral triangle of which the apex points inward and the base points outward in FIG. 7, arrangement of the small-diametrical punches 8*a*1, 8*a*2, . . . is not necessarily limited to that shown in FIG. 7.

A gear 9 is secured to a cylindrical portion of the upper turret 6, and interlocks with a drive means (not shown) to rotate the upper turret 6, and effects location of punches of the upper turret 6. A lower frame 2*b* of the press body 2 carries a lower turret 10 which is horizontally rotatable along the central axis M, and provided with large dies 71*a*, 71*b*, . . . and small dies 81*a*1, 81*b*1, 81*c*1, 81*a*2, 81*b*2, 81*c*2, . . . corresponding with the small-diametrical punches 8*a*1, 8*b*1, 8*c*1, 8*a*2, 8*b*2, 8*c*2, . . .

A gear 11 is secured to a cylindrical portion of the lower turret 10, and interlocks with a drive means (not shown) to rotate the lower turret 10, and is synchronized with the gear 9 to effect location of the dies of the lower turret 10 with respect to the punches of the upper turret 6. Namely, the upper and lower turrets 6 and 10 are always integrally rotated for location of the punches and dies, and centering of the large-diametrical punches 7*a*, 7*b*, . . . and the circular subtracks B1, B2, . . . is effected by a center pin 19 reciprocably provided with respect to the lower frame 2*b* and a pin hole 20 provided in the lower turret 10 (see FIG. 7).

Figure 5:
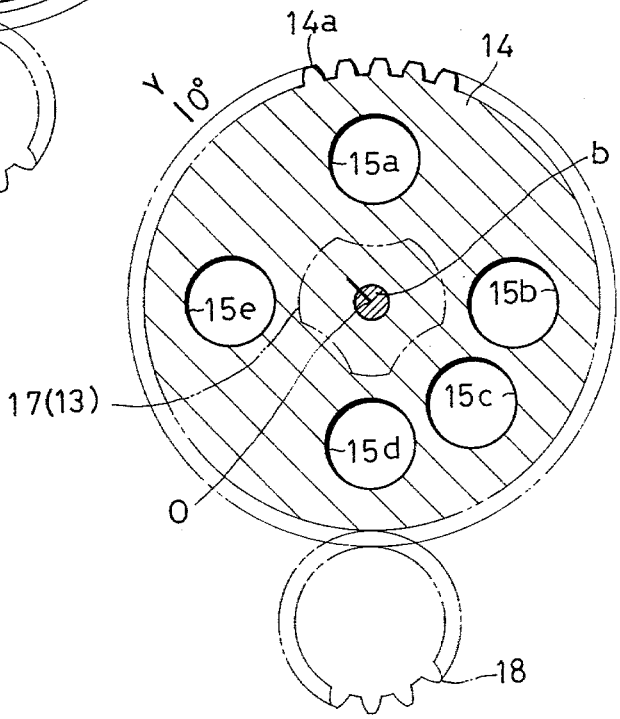
FIG. 5 is a cross-sectional view taken along the lines V—V in FIG. 2.

A ram 12 is suspendedly supported by the upper frame 2*a* for vertical motion therealong, and a main striker 13 is secured to the center of the ram 12 by a bolt b. A shutter 14 having a plurality of gears 14*a* in its periphery is rotatably pivotted to a neck 13*a* forming the upper part of the main striker 13. The shutter 14 is provided with a plurality of apertures 15*a* through 15*e*, and as shown in FIG. 5, the apertures 15*a*, 15*b*, 15*c*, 15*d* and 15*e* are respectively arranged at angles of 45°, 135°, 180°, 225° and 315° on an axis O–Y in the clockwise direction.

The aforementioned arrangement of the apertures 15*a* through 15*e* is varied depending on arrangement of three substrikers 16*a*, 16*b* and 16*c* as hereinafter described.

The substrikers 16*a* through 16*c* are provided in a supporting disk 13*b* in the lower portion of the main striker 13 to correspond with the aforementioned each three small diametrical punches 8*a*1, 8*a*2, . . . for vertical movement.

The substrikers 16*a* through 16*c* are prevented from displacement by flanges 16*f* formed in the upper portions thereof, which, in turn, can be inserted into the apertures 15*a* through 15*e*.

A main striking end 17 extending downwardly from the main striker 13 has radially spaced recesses 17*a* to 17*c* for preventing interference with the heads of the small-diametrical punches 8*a*1, 8*a*2, . . .

A pinion 18 is rotatably supported by the upper frame 2*a* to be engaged with the gears 14*a* of the shutter 14 and vertically move along with the vertical movement of the ram 12.

The pinion 18 is rotated by a rack (not shown) which is driven by a hydraulic cylinder (not shown), and the shutter 14 is rotated at a certain degree synchronized with selective action of the small-diametrical punches 8a1, 8a2, . . . by rotation of the rack. Each aperture of the shutter 14 is also rotated simultaneously with each corresponding small-diametrical punch to select an appropriate substriker.

Figure 6:
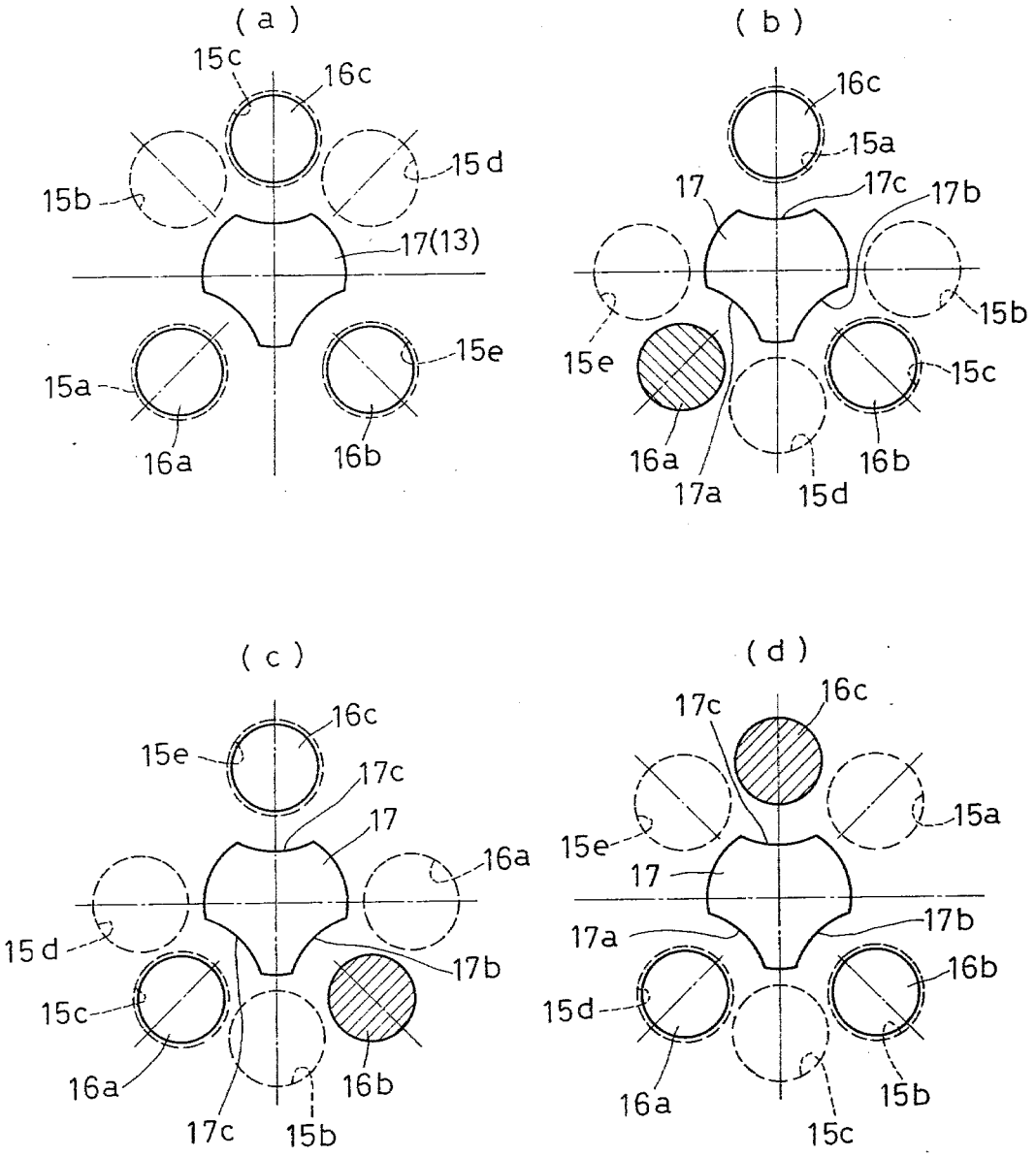
FIGS. 6(*a*) through 6(*d*) are illustrative views showing selection of the strikers.

In case the work-piece W is to be punched by one of the large-diametrical punches, the upper and lower turrets 6 and 10 are synchronizedly rotated at certain pitches by the gears 9 and 11 respectively to select an appropriate large-diametrical punch while the gear 14a of the shutter 14 is rotated at a certain angle synchronized with location of the turrets 6 and 10 through the pinion 18 to align the apertures 15a, 15c and 15e with the substrikers 16a, 16b and 16c with respect to the flanges 16f as shown in FIG. 6(*a*). Alternatively, the end surfaces of the substrikers 15a to 15c may be positioned on the same plane as or a bit higher than the end surface of the main striker 13, and in this case, the angle of rotation of the shutter 14 need not be specially selected and the substrikers 16a to 16c may be utilized for striking the large-diametrical punches when the end surfaces thereof are on the same plane as that of the main striker 13.

After the appropriate large-diametrical punch is selected and the positioning thereof is assured by the center pin 19, punching is effected by the main striker 13 provided in the lower portion of the ram 12 against the selected large-diametrical punch.

When, for example, the small-diametrical punch 8a1 on the subtrack B1 is to be selected for punching the work-piece W, the upper and lower turrets 6 and 10 are synchronizedly rotated at certain pitches through the gears 9 and 11 respectively to effect centering of the subtrack B1 by the center pin 19 and align the same with the center of the ram 12. On the other hand, the gear 14a of the shutter 14 is automatically rotated in conjunction with the aforementioned synchronized rotation of the upper and lower turrets 6 and 10, and the apertures 15c and 15a are aligned with the substrikers 16b and 16c respectively while the substriker 16a right above the small-diametrical punch 8a1 is shut by the shutter 14 as shown in FIG. 6(*b*). Namely, the substriker 16a becomes ready for striking while the other two substrikers 16b and 16c are prevented by the apertures 15c and 15a from striking and when the ram 13 is lowered in this condition, striking against the small-diametrical punch 8a1 is effected only by the substriker 16a through the flange 16f contacting the solid portion of the shutter 14.

It is to be noted that the main striker 13 will not actuate the substrikers 16a to 16c when the ram 13 is lowered by virtue of the recesses 17a to 17c provided in its striking end 17 [see FIG. 6(*b*)]. Namely, the main striker 13 will not affect the substrikers 16a to 16c in operation.

When another substriker 16b is to correspond with the small-diametrical punch 8b1, the shutter 14 is rotated synchronizedly with the upper and lower turrets 6 and 10 so that the apertures 15c and 15e are aligned with the substrikers 16a and 16c respectively and the substriker 16b right above the punch 8b1 is shut by the shutter 14. Namely, the substriker 16b becomes ready for striking while the other two substrikers 16a and 16c are prevented by the apertures 15c and 15e from striking, and when the ram 13 is lowered in this condition, striking against the small-diametrical punch 8b1 is effected only by the substriker 16b through the flange 16f contacting the solid portion of the shutter 14 [see FIG. 6(*c*)].

Further, when the substriker 16c is to correspond with the small-diametrical punch 8c1, the shutter 14 is rotated synchronizedly with the upper and lower turrets 6 and 10 so that the apertures 15b and 15d are aligned with the substrikers 16a and 16b respectively and the substriker 16c right above the punch 8c1 is shut by the shutter 14. Namely, the substriker 16c becomes ready for striking while the other two substrikers 16a and 16b are prevented by the apertures 15b and 15d from striking, and when the ram 13 is lowered in this condition, striking against the small-diametrical punch 8c1 is effected only by the substriker 16c through the flange 16f contacting the solid portion of the shutter 14 [see FIG. 6(*d*)].

As hereinabove described, the main striker and three substrikers are systematically operated in the present invention. According to the present invention, punching of the work-piece W can automatically be effected in predetermined order by conducting location of the turrets and selection of the main striker and the substrikers in connecton with each other by an automatic control system. Namely, in the present invention, the main striker and the substrikers can always be selected at random. Since a plurality of strikers are provided in the present invention, selection time is reduced in comparison with the prior art in which only one striker is moved to select an appropriate punch, and durability of each striker is increased. Further, movement for selection of the substriker is smoothed since it is conducted by rotaton of the shutter.

While the invention has been described with reference to a preferred embodiment thereof, it is to be understood that modifications or variations may be easily made without departing from the scope of this invention which is defined by the appended claims.

What is claimed is:

1. A turret type punch press having a plurality of strikers, said punch press comprising:

a turret mechanism;

a plurality of large-diametrical punches radially spaced along a main circular track of said turret mechanism;

a plurality of small-diametrical punches spaced along a plurality of subtracks centering around points on said main circular track between every two adjacent large-diametrical punches;

a main striker provided in the lower end of a ram to correspond with said large-diametrical punches; and a plurality of substrikers provided circumferentially around said main striker to correspond with said small-diametrical punches, said main striker and substrikers being selectively operated according to selection of said punches.

2. The turret type punch press as defined in claim 1 wherein one of said substrikers is selected to correspond with an appropriate one of said small-diametrical punches by rotation of a shutter comprising a rotating plate.

3. The turret type punch press as defined in claim 1 wherein said main striker is secured to the center of said lower end of said ram and is radially recessed at certain portions to prevent interference with said small-diametrical punches.

* * * * *